US006834394B2

(12) United States Patent
MacDonald

(10) Patent No.: US 6,834,394 B2
(45) Date of Patent: Dec. 28, 2004

(54) COASTER MASK AND METHOD FOR ASSEMBLING SAME

(76) Inventor: Andrew MacDonald, 8215 Greenwood Ave. North, Seattle, WA (US) 98103

( * ) Notice: Subject to any disclaimer, the term of this patent is extended or adjusted under 35 U.S.C. 154(b) by 146 days.

(21) Appl. No.: 10/189,115

(22) Filed: Jul. 3, 2002

(65) Prior Publication Data

US 2004/0003446 A1 Jan. 8, 2004

(51) Int. Cl.[7] ..... A41D 13/00
(52) U.S. Cl. ..... 2/9; 248/346.11; 446/27
(58) Field of Search ..... 248/346.11, 684; 132/319; 2/174, 9, 206, 11; 446/27; 472/133; 40/586; 128/857

(56) References Cited

U.S. PATENT DOCUMENTS

| | | | | |
|---|---|---|---|---|
| 730,357 | A | 2/1903 | Eschenbach | |
| 1,082,987 | A | * 12/1913 | Williams | 2/10 |
| 1,166,977 | A | * 1/1916 | Favary | 2/11 |
| D177,082 | S | 3/1956 | Wolf | D34/15 |
| 3,060,445 | A | * 10/1962 | Brockman | 2/9 |
| 3,220,684 | A | 11/1965 | Milne | 248/346.1 |
| 3,602,913 | A | * 9/1971 | Neese | 2/9 |
| 4,063,740 | A | * 12/1977 | Mader | 473/210 |
| D254,226 | S | 2/1980 | Morse | D7/45 |
| 4,586,280 | A | 5/1986 | Dane | 40/329 |
| 5,018,695 | A | 5/1991 | Bishop | 248/346.1 |
| 5,214,800 | A | 6/1993 | Braun | 2/173 |
| D352,416 | S | * 11/1994 | Dutton | D7/300.2 |
| D355,123 | S | 2/1995 | Romano | D9/456 |
| D372,845 | S | 8/1996 | Meier | D7/625 |
| 5,617,584 | A | 4/1997 | Brennan | 2/206 |
| 5,717,992 | A | 2/1998 | Tilghman | 2/9 |
| 6,023,784 | A | 2/2000 | Yeal | 2/9 |
| 6,032,292 | A | 3/2000 | Wood et al. | 2/207 |

* cited by examiner

*Primary Examiner*—Katherine Moran
(74) *Attorney, Agent, or Firm*—Thomas E. Logo

(57) ABSTRACT

A novelty face mask is assembled from one or two coasters and a conventional drinking straw. One embodiment of the coaster is of generally circular shape with a linear slot proximate the outer edge, such slot defining a tab on the coaster that can be inserted into one end of the straw and a peephole strategically located so as to accommodate a user's eye. Two such coasters can be used with one straw, and in this case, both tabs are inserted together into the straw's end. The two coasters will normally be covered with a complementary design such that the assemblage of the coasters and the straw creates a novelty face mask, which may be promotional, celebratory, or of some other theme. A method for assembling such masks and the resulting masks are disclosed.

9 Claims, 5 Drawing Sheets

COASTER MASK AND METHOD FOR ASSEMBLING SAME

TECHNICAL FIELD

The present invention relates generally to novelty masks, and more specifically, to novelty face masks assembled from beverage coasters and drinking straws.

BACKGROUND OF THE INVENTION

Beverage coasters are used in many situations to protect furniture and other surfaces from the heat or condensation of beverage containers. Many such coasters, which can be made from cardboard, cork, plastic, or other material, are provided in restaurants and bars for the use by patrons with their various beverages.

There have been a few attempts in the prior art to add various features to these coasters, so as to make them even more useful to the user or to the drinking establishment. For instance, the coaster disclosed in U.S. Pat. No. 4,829,618 to McKee has a slot for opening tabbed cans and a twist grip for opening twist-off bottle caps and can be used by the users (particularly beer-drinkers) to perform these additional functions. The coaster disclosed in U.S. Pat. No. 3,220,684 to Milne has a holder for business or other advertising cards attached thereto and can be used by the drinking establishment to promote its products and services. Finally, the coaster disclosed in U.S. Design Pat. No. D372,845 to Meier is in the shape of a golf green with the words "19th HOLE" and can be used to celebrate an event such as a golf tournament. Meier's design, however, is still simply a design for a coaster and is to be used as such.

In addition to coasters, there are a variety of masks known in the prior art, masks such as those disclosed in U.S. Design Pat. No. D244,880 to Terry (an ornamental design for a spray mask having a stick holder and a generally rectangular mask portion that covers the nose and eyes) and in U.S. Pat. No. 3,009,163 to Beauvais (a spectacle mask having a festive motif). Because such masks are neither planar nor absorbent, they cannot be used as coasters. In addition, these prior art masks are not easily or readily assembled and disassembled.

Accordingly, there is still a need in the art for coasters having new features and added functionalities. The present invention fulfills these needs and provides for further related advantages.

SUMMARY OF THE INVENTION

In brief, the present invention relates generally to a coaster, or coasters, which can be used by a user not only as the usual furniture protector or condensation collector but also as a festive mask for shielding or covering the user's face. The preferred embodiment of the coaster is made of heavy cardboard, but could be of corkboard, plastic, or any other acceptable material, and is covered with a colorful, festive design, such design being modified as appropriate for particular celebrations, events, or other purposes.

The coaster of the preferred embodiment is of a generally round, planar shape with a circular peephole punched through the coaster (and located so as to be integral with the design) and a generally linear slot located proximate the outer edge, such slot being open at one end and thus creating a tab which can be inserted into one end of a straw, such as a generally cylindrical conventional drinking straw. A user can assemble a mask by inserting the coaster tab into the end of the straw and then holding the straw so that the coaster shields his face with the peephole positioned over one eye. As a kit, the coaster and the straw could be provided together, and the design on the coaster and straw could be chosen to be appropriate to a particular celebration or event.

In an alternate embodiment, a mask kit can be provided comprising two generally round, planar coasters and one generally cylindrical straw. In this embodiment, each generally planar coaster has at least one selectively sized, shaped, and positioned peephole, and a generally linear slot proximate the outer edge of the coaster. In this configuration, the tabs of both coasters are adapted to fit snugly together into the open end of the single straw. In other words, the maximum width of the tab is about the same as or slightly larger than the inner diameter of the cylindrical straw, thereby allowing the tabs to fit securely within the shaft portion of the straw. The mask is assembled by the user placing the tabs of each coaster into one of the open ends of the straw such that (i) the two tabs of the two coasters overlap each other within the straw, and (ii) the two linear slots of the two coasters are in a substantially parallel relationship to each other.

The coaster mask kit could easily be adapted in shape, material, and design to accommodate a variety of purposes. It has already been mentioned that the design could be modified for particular celebrations (such as holidays and birthdays) and events (such as sports tournaments, company parties, and fundraisers). Of course, with different designs, there could be two or more peepholes, and the peepholes could be of any shape. Also, the coasters could be provided in generally square, rectangular, triangular, or any other regular or irregular shape. (As long as the coasters are generally planar, then they can perform their dual functions of mask and coaster.)

DETAILED DESCRIPTION OF THE INVENTION

Figure 1:
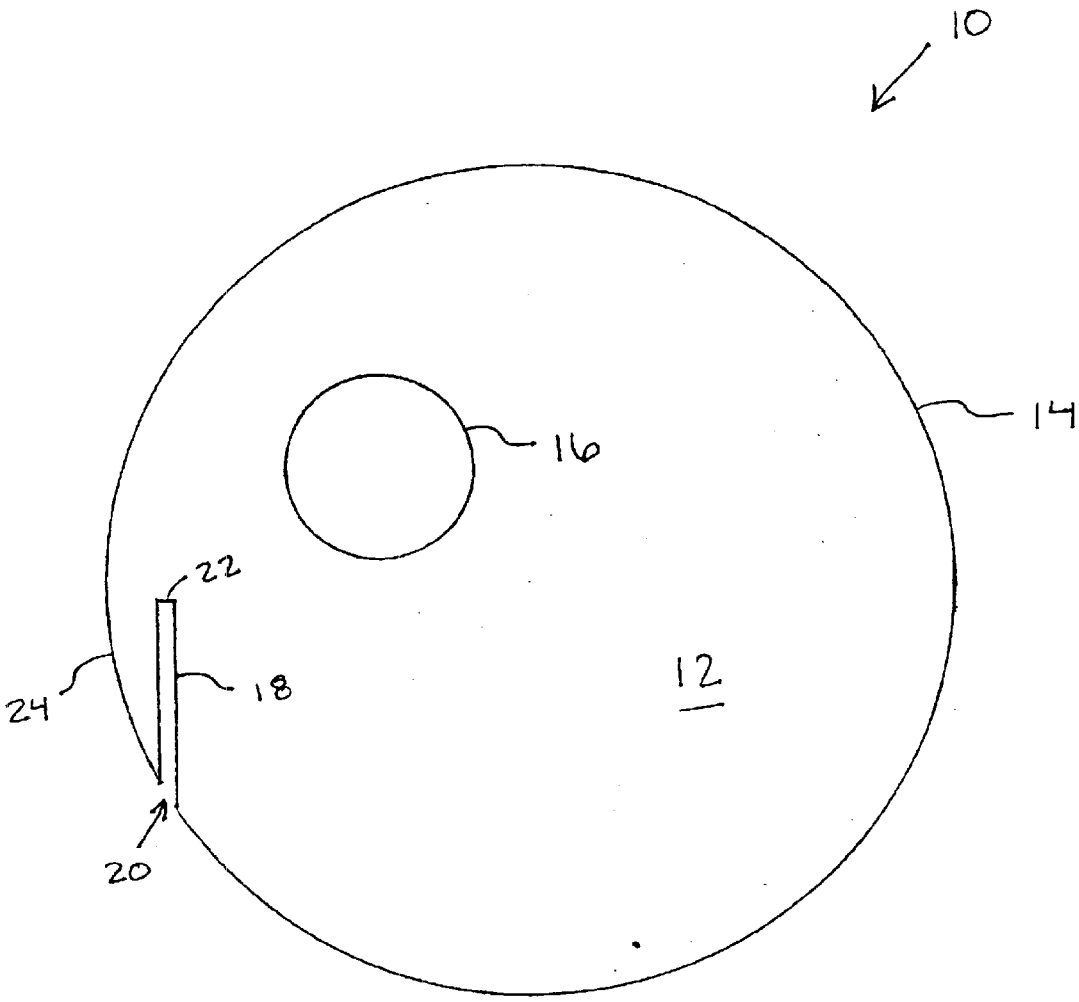
FIG. 1 illustrates a top view of a coaster having a peephole and slot in accordance with an embodiment of the present invention.

The present invention relates generally to novelty masks, and more specifically, to novelty face masks assembled from beverage coasters and drinking straws. In the embodiment shown in FIG. 1, the coaster 10 is made of a generally circular, generally planar sheet 12 with an outer peripheral edge 14. The sheet 12 could be cut in any other planar shape, such as a square (which is a usual shape for coasters), oval, polygon, or even an irregular shape such as a golf green or cloud. Likewise, the sheet 12 could be of any suitable material, e.g., corkboard, plastic, or cloth, but in one preferred embodiment, heavy cardboard or pulpboard is chosen.

The coaster 10 comprises two distinct features: the peephole 16, which in one preferred embodiment is generally circular and is intended for the user to look through, and the tab 24 which is defined proximate the peripheral edge 14 by the slot 18 and is usually sized to be inserted snugly into the open end of a conventional drinking straw. The slot 18 has an open end 20 located on the peripheral edge and a closed end 22 located within the sheet 12. In the figure, the closed end 22 of the slot 18 is square; however, in alternate embodiments the closed end 22 could be rounded or even more acute than that shown.

Likewise, the peephole 16 could be of various different shapes and designs in alternate embodiments, such as a star or crescent shape. The peephole may be provided within the coaster as perforations to be punched out by the user. In the following discussion, for purposes clarity, the peepholes will be shown as already punched out.

Figure 2:
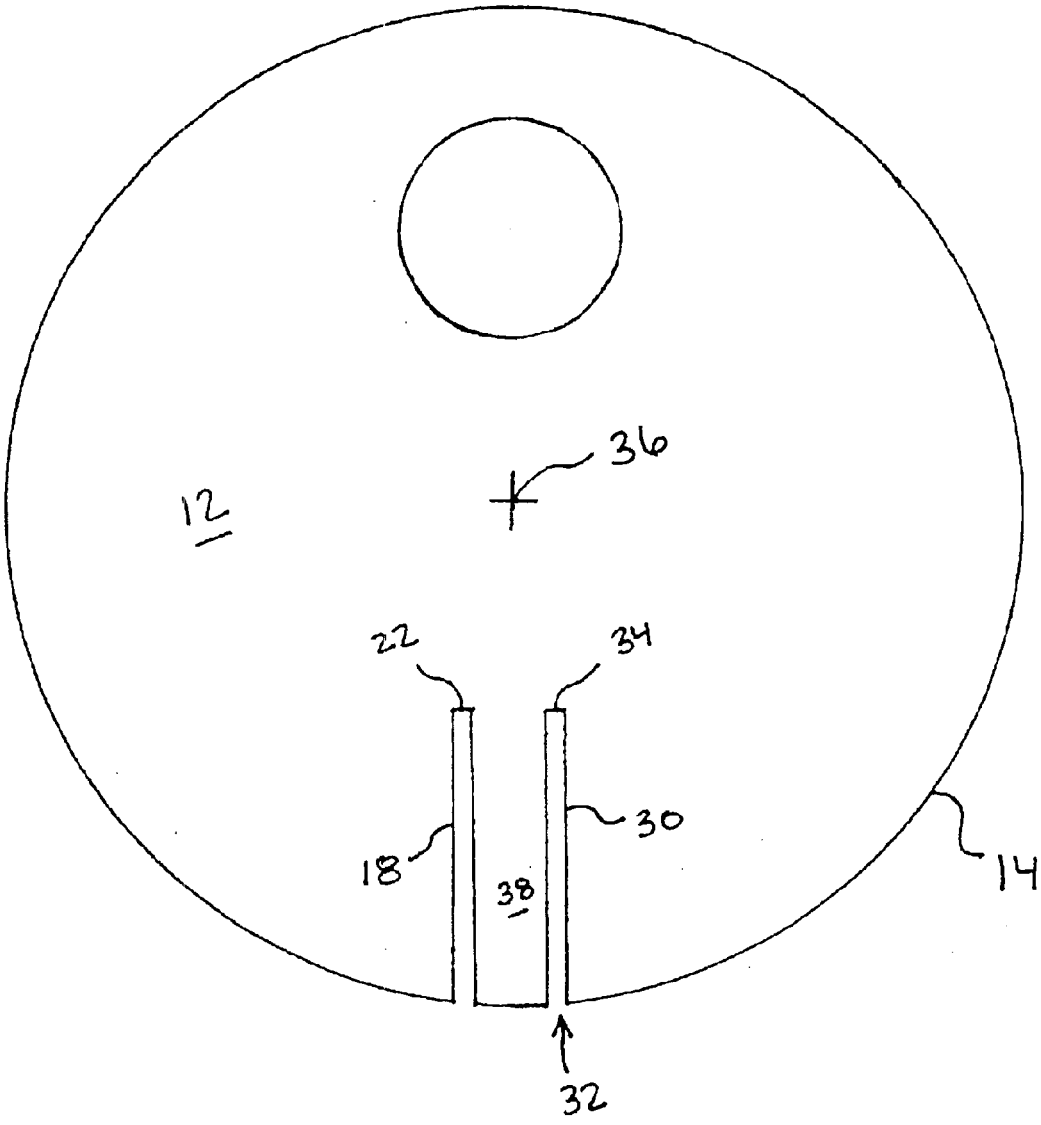
FIG. 2 illustrates a top view of a coaster having a peephole and slot in accordance with another embodiment of the present invention.

FIG. 2 shows a first alternate embodiment of the coaster 28. In this alternate embodiment, there is a second slot 30, also with an open end 32 on the outer edge 14 and a closed end 34 located within the sheet 12. The two slots 18 and 30 are oriented generally parallel to each other and, being generally the same length, are oriented with the closed ends 22 and 34 toward the geometric center 36. In this configuration, a tab 38 is defined between the slots 18 and 30, which tab is sized to fit within an open end of a drinking straw. In still other alternate configurations, the tab defined by the two slots could be off center, askew, or oriented in some way other than that shown. Moreover, the tab could protrude beyond the boundary of the outer peripheral edge of the rest of the sheet.

Figure 3:
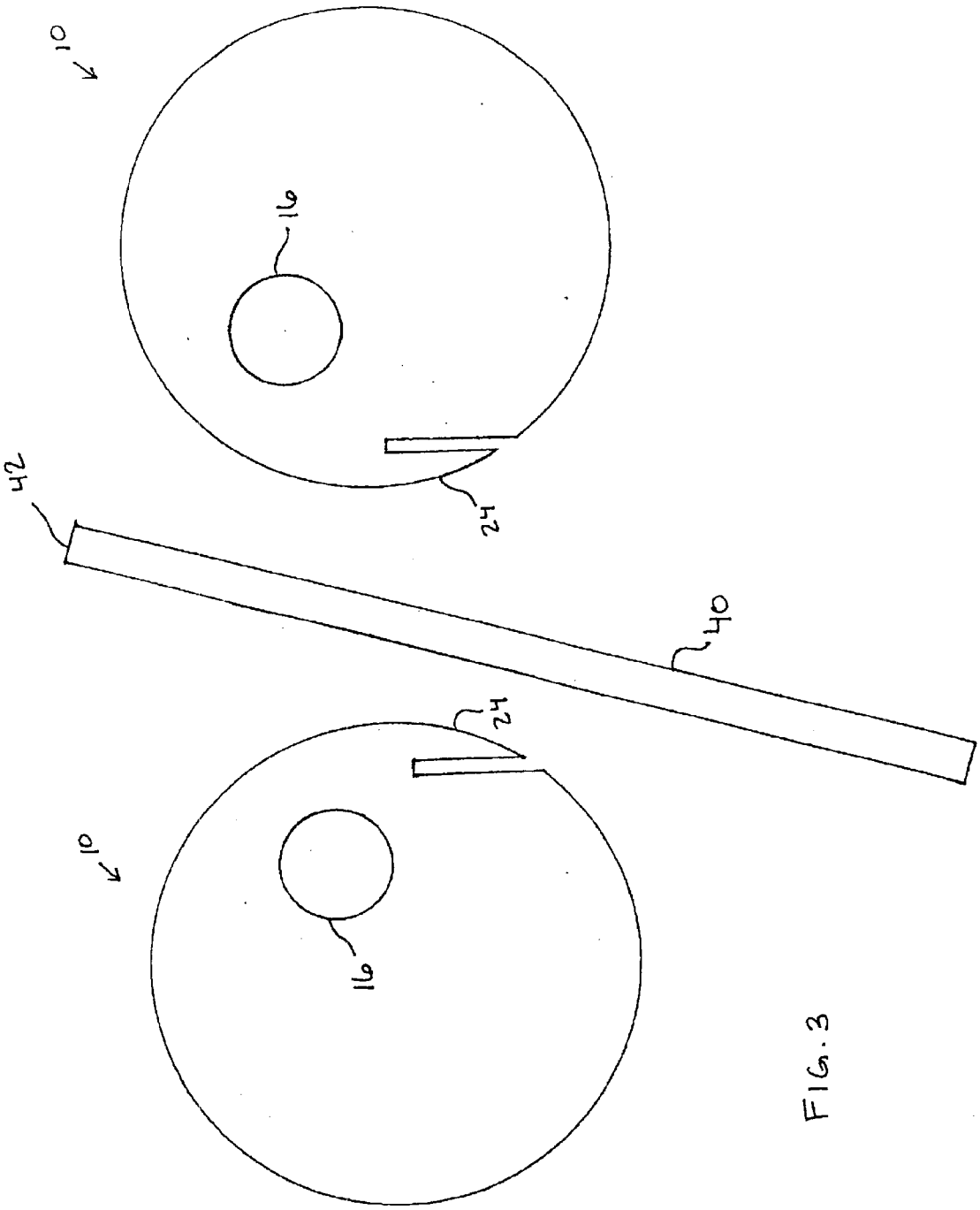
FIG. 3 illustrates a top disassembled view of a coaster mask kit slot in accordance with an embodiment of the present invention., wherein the coaster mask kit consists essentially of a pair of specialty coasters and a straw.
Figure 4:
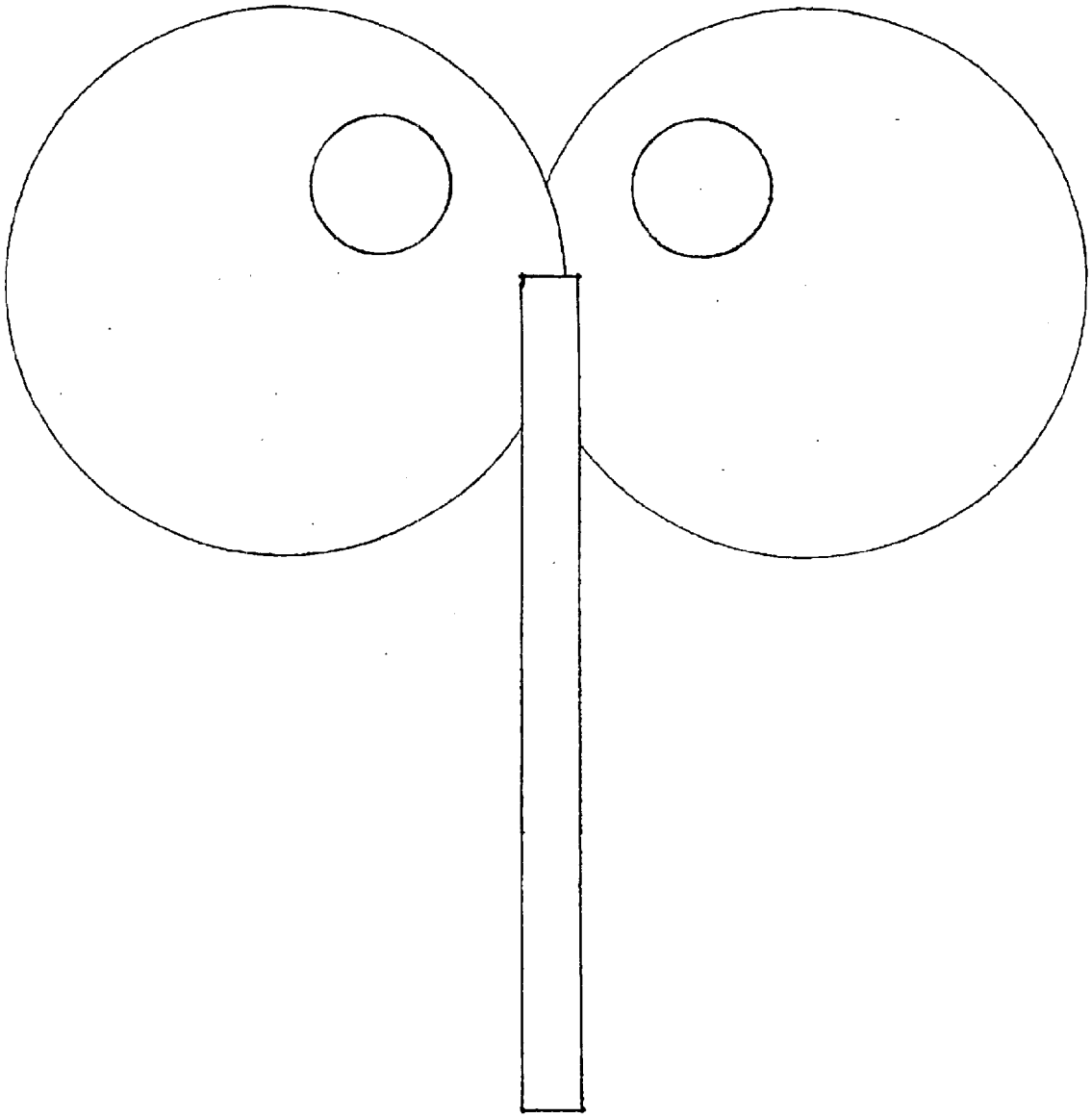
FIG. 4 illustrates a top view of a face mask assembled from a pair of coasters and a straw in accordance with an embodiment of the present invention.

FIG. 3 shows a coaster mask kit comprising two coasters 10 according to the preferred embodiment and a conventional drinking straw 40. In the kit shown, the coasters 10 are mirror images of one another, such that the tabs 24 and the peepholes 16 are similarly sized. FIG. 4 shows the kit assembled into a mask. The mask is assembled by the user placing the tabs of each coaster into the open end 42 of the straw such that (i) the two tabs 24 of the two coasters 10 overlap each other within the shaft of the straw 40, and (ii) the two linear slots 18 of the two coasters are in a substantially parallel relationship to each other. When this embodiment is properly assembled, the user will be able to see through the two peepholes 16.

Figure 5:
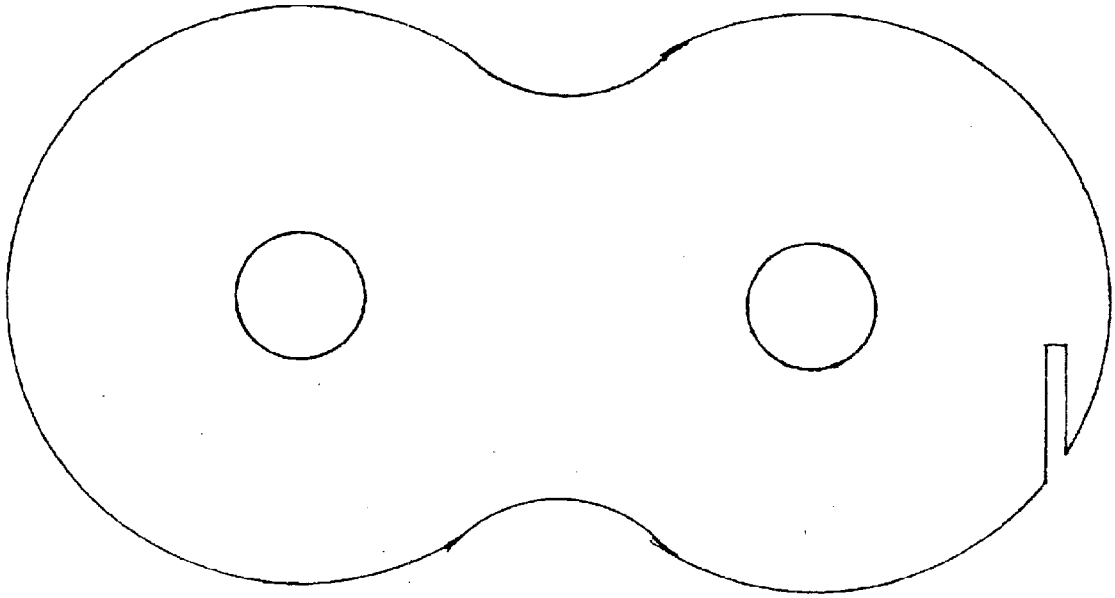
FIG. 5 is a top view of a coaster in accordance with an embodiment of the present invention.

The straws need not be conventional, but could be uniquely sized, so long as they match the coaster tabs, for a particular kit. FIG. 5 shows a second alternate embodiment of the present invention, in which the sheet is not of circular shape, and there are two peepholes.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A coaster mask kit comprising:

a generally planar coaster, such coaster having an outer peripheral edge and a first substantially linear slot, such slot having an open end and a close end and being positioned so that the open end is located on the outer peripheral edge and the closed end is located within the coaster and a tab is defined by the slot, such tab being sized to fit within the end of a generally cylindrical straw; and a generally cylindrical straw having two open ends, at least one of the ends being capable of accepting and holding the tab of the coaster.

2. The coaster mask kit of claim 1 further comprising:

a second substantially linear slot, such slot having an open end and a closed end and being positioned so that the open end is located on the outer peripheral edge and the closed end is located within the coaster and the tab is defined between the first slot and the second slot, such tab being sized to fit within the end of a generally cylindrical straw.

3. The coaster mask kit of claim 2 wherein:

the coaster is of a generally circular shape having a geometric center, and the first slot and the second slot are positioned generally parallel to each other so that the open ends are located on the outer peripheral edge and the closed ends are oriented towards the geometric center of the coaster.

4. The coaster mask kit of claim 1 further comprising a second generally planar coaster, such second coaster having an outer peripheral edge and a first substantially linear slot, such slot having an open end and a closed end and being positioned so that the open end is located on the outer peripheral edge and the closed end is located within the coaster and a tab is defined by the slot, such tab being sized to fit within the end of a generally cylindrical straw; and wherein the open end of the straw is capable of accepting and holding the tabs of both the first coaster and the second coaster.

5. The kit of claim 1 wherein the cylindric straw is a conventional drinking straw.

6. A method for assembling a coaster mask from a coaster mask kit, such kit comprising a generally planar coaster having an outer peripheral edge and a first substantially linear slot, such slot having an open end and a closed end and being positioned so that the open end is located on the outer peripheral edge and the closed end is located within the coaster and having a tab defined by the slot, such tab being sized to fit within the open end of a generally cylindrical straw and a generally cylindrical straw having an open end, such end being capable of accepting and holding the tab of the coaster, the method comprising the steps of:

inserting the tab of the coaster into the open end of the straw until the tab is well-mounted therein; and grasping straw and holding it vertically so that the coaster at least partially covers the user's face.

7. A method for assembling a coaster mask from a coaster mask kit, such kit being comprised of a first coaster and a second coaster, each coaster having an outer peripheral edge and defining an integral tab proximate the outer peripheral edge, and one generally cylindrical straw, such straw having at least one open end, the method comprising the steps of:

inserting the tab of the first coaster into the open end of the straw; and inserting the tab of the second coaster into said open end of the straw so that the tabs overlap within the straw.

8. The method of claim 7 wherein the straw has a flexible wall and the flexible wall of the straw deforms upon insertion of the coaster tabs.

9. A face mask consisting essentially of:

one or more coasters; and a straw wherein each of the one or more coasters has at least one selectively sized, shaped, and positioned peephole, and wherein each of the one or more coasters has an outer peripheral edge and a substantially linear slot that has (i) an open end positioned at the outer peripheral edge, and (ii) a closed end positioned within the outer peripheral edge, and wherein the substantially linear slot defines an integral tab, and wherein an open end of the straw has been securely fitted onto the integral tab.

* * * * *